United States Patent [19]

Geddes

[11] 4,309,825

[45] Jan. 12, 1982

[54] STENCIL

[76] Inventor: David C. Geddes, 72 Jedburgh Rd., Toronto, Ontario, Canada

[21] Appl. No.: 134,206

[22] Filed: Mar. 26, 1980

[51] Int. Cl.[3] ..... B43L 13/20

[52] U.S. Cl. ..... 33/174 B; 101/127

[58] Field of Search ..... 434/85, 87; 33/174 B, 33/1 B, 27 C, 27 R, 27 K, 184.5, 184.6; 101/127, 129, 114, 115

[56] References Cited

U.S. PATENT DOCUMENTS 329,476 11/1885 Miller ..... 101/127
338,621 3/1886 Stines ..... 101/127
1,568,864 1/1926 Bahr ..... 101/115
2,066,477 1/1937 Levin ..... 101/127 X
3,465,445 9/1969 Fisher ..... 33/27 C
3,633,286 1/1972 Maurer ..... 33/174 B

*Primary Examiner*—Harry N. Haroian

[57] ABSTRACT

A stencil for a design having an outline and a center blank, comprising a main stencil member and an auxiliary stencil member. The main member has an opening defining the design outline and the auxiliary member has a subtending portion registrable with the opening in the main member. An opening through the auxiliary member and the subtending portion defines the center blank.

1 Claim, 4 Drawing Figures

STENCIL

FIELD OF THE INVENTION

This invention relates to a stencil for the production of a design having inner and outer unconnected outlines.

BACKGROUND OF THE INVENTION

Stencils for designs having inner and outer unconnected outlines, such as the centre blanks of the letters A, B, D, O, P, Q and R of the alphabet, requires one or more interconnecting bridges to hold the centre blanks. Examples of such stencils are shown in U.S. Pat. No. 2,041,993 issued May 26, 1936 to A. F. Cousins and U.S. Pat. No. 2,651,989 issued Sept. 14, 1953 to W. J. Kerr. The device of Cousins requires the outline of the design to be broken by the bridges and to overcome this disadvantage Kerr has resorted to an elaborate and cumbersome structure.

It is an object of the present invention to provide a stencil for a design including a centre blank, in which the centre blank and the outline are unconnected.

SUMMARY OF THE INVENTION

In its broadest aspect the invention consists of a stencil for a design having an outline and a centre blank, comprising: a main stencil member having a first opening therethrough defining a design outline; and an auxiliary stencil member having a subtending portion registrable with said first opening in the main stencil member, the auxiliary stencil member and the subtending portion having a second opening therethrough defining a centre blank, the second opening lying wholly within the first opening and separated inwardly therefrom when the auxiliary member is in registration with the main member.

DESCRIPTION OF THE DRAWINGS

An example embodiment of the invention is shown in the accompanying drawings in which.

DESCRIPTION OF PREFERRED EMBODIMENT

Figure 1:
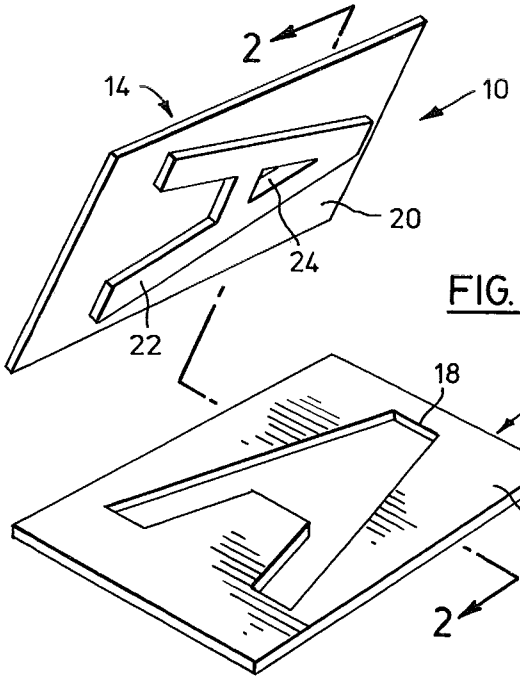
FIG. 1 is an exploded perspective view of a composite stencil.
Figure 2:
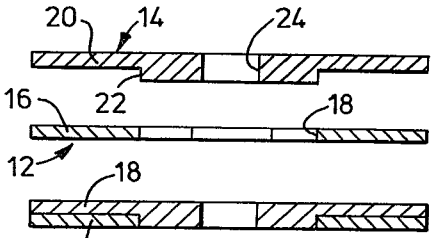
FIG. 2 is a cross-sectional view taken along line 2—2 of FIG. 1.
Figure 3:
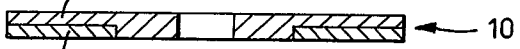
FIG. 3 is a cross-sectional view similar to FIG. 2 showing the two stencil members interfitted.

The example embodiment shown in the drawings consists of a composite stencil 10 comprising a main stencil member 12 and an auxiliary stencil member 14 as seen in FIG. 1. Main stencil member 12 consists of a sheet 16 of form retaining material having an opening 18 shaped circumferentially to the main outline of the design to be drawn on a designated surface, shown here as the letter A. Auxiliary stencil member 14 consists of a sheet 20 of form retaining material having subtending from its underside a portion 22 peripherally shaped to register with opening 18 of main stencil member 12 when sheet 20 is laid on sheet 16, as seen in FIG. 3. An opening 24, located in sheet 20 and subtending portion 22 of auxiliary stencil member 14, corresponds to the centre blank of the design.

Figure 4:
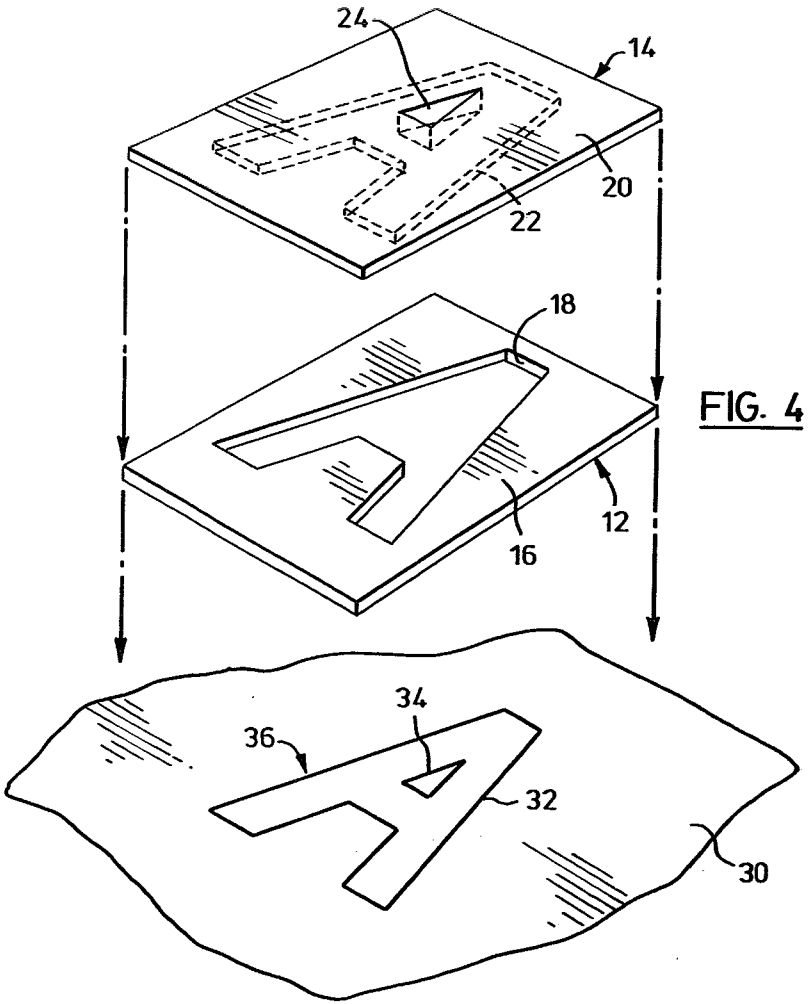
FIG. 4 is an exploded perspective view showing the step of adding the centre blank to the stencil pattern.

In the use of the example embodiment, main stencil member 12 is placed on surface 30 on which the design of stencil 10 is to be received and the main outline 32 of the design is drawn on the surface using the periphery of opening 18 as a guide, as seen in FIG. 4. After outline 32 has been completed, auxiliary stencil member 14 is placed on main stencil member 12 to have subtending portion 22 of the auxiliary member register with opening 18 in the main member. Centre blank 34 of the design is then drawn on surface 30 using the periphery of opening 24 as a guide. Both members 12 and 14 are then removed from surface 32, leaving the complete design 36 imprinted on surface 30 with no connectors or bridges appearing between outline 32 and centre blank 34.

For convenience, sheet 16 of main stencil member 12 and sheet 20 auxiliary stencil member 14 could be formed of a unitary sheet.

I claim:

1. For drawing a letter of the alphabet of the class comprising A, B, D, O, P, Q and R having an outline and a centre blank unconnected with the outline:

a main stencil member having a first opening therethrough defining said outline; and an auxiliary stencil member having an inwardly stepped subtending portion also defining said outline and registrable in mating relationship with the first opening in the main stencil member, the auxiliary stencil member and the subtending portion having a second opening therethrough defining said centre blank, the second opening lying wholly within the first opening and separated inwardly therefrom when the subtending portion mates with the first opening.

* * * * *